US005611471A

United States Patent [19]

French

[11] Patent Number: 5,611,471

[45] Date of Patent: Mar. 18, 1997

[54] GUN HOLSTER

[76] Inventor: Thomas French, 21 Manor Blvd., Troy, N.Y. 12180

[21] Appl. No.: 519,767

[22] Filed: Aug. 28, 1995

[51] Int. Cl.[6] ..... F41C 33/02

[52] U.S. Cl. ..... 224/243; 224/244; 224/666; 224/912

[58] Field of Search ..... 224/192, 244, 224/243, 912, 198, 666

[56] References Cited

U.S. PATENT DOCUMENTS

| | | | |
|---|---|---|---|
| 1,113,530 | 10/1914 | Audley . | |
| 1,917,844 | 10/1930 | Keith . | |
| 2,001,321 | 5/1935 | Berns | 224/666 X |
| 2,109,734 | 10/1936 | Preneta | 224/244 |
| 2,758,762 | 8/1956 | Medley | 224/243 |
| 3,353,728 | 3/1966 | Freed | 224/243 |
| 3,910,469 | 10/1975 | Baldocchi | 224/912 |
| 4,318,503 | 3/1982 | Capano . | |
| 4,870,771 | 10/1989 | McClellan . | |
| 5,167,355 | 12/1992 | Hill | 224/243 X |
| 5,358,160 | 10/1994 | Bianchi | 224/244 |
| 5,467,909 | 11/1995 | Resca et al. | 224/244 |

*Primary Examiner*—Renee S. Luebke
*Attorney, Agent, or Firm*—Schmeiser, Olsen & Watts

[57] ABSTRACT

A gun holster comprising a main frame, two flattened C-shaped pieces or the like for mounting the holster to an object, a trigger guard support arm or the like to prevent lateral movement, and a gun support such as a barrel support arm, is provided. Also, either a frame support arm or a cylinder locking arm, depending on the type of pistol to be holstered, are provided. The holster may also comprise a unitary piece so that it is simple and inexpensive to manufacture.

10 Claims, 3 Drawing Sheets

FIG. 1
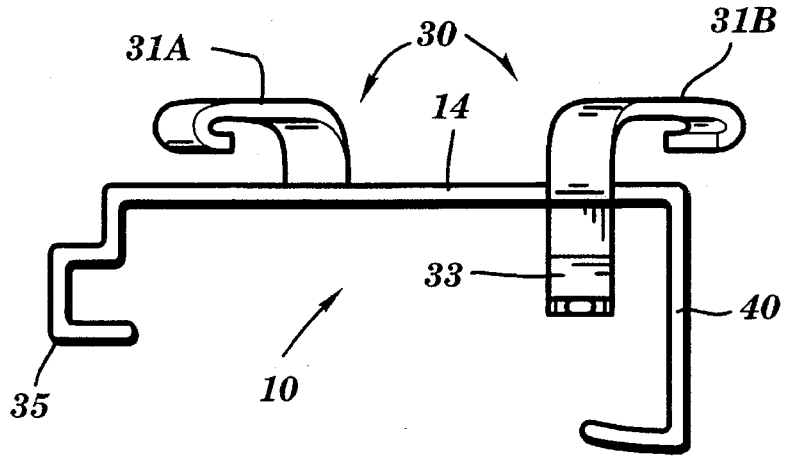
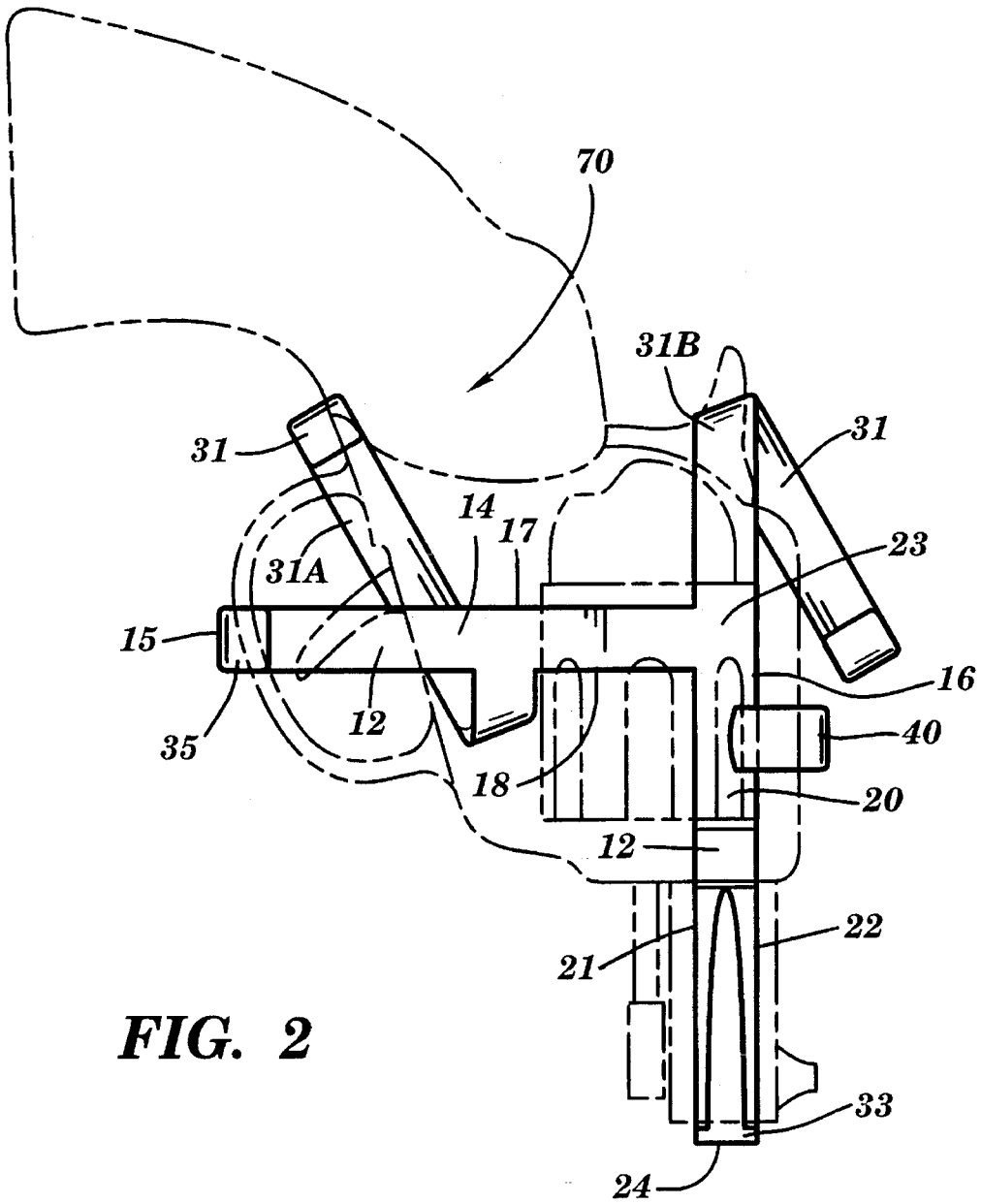
FIG. 2

GUN HOLSTER

FIELD OF THE INVENTION

The present invention relates generally to holsters for guns. In particular, the present invention is concerned with a unitary gun holster designed to only allow the gun to be drawn with a specific motion and also to effectively prevent the gun from being fired while in the holster.

BACKGROUND OF THE INVENTION

Handgun holders for small handguns and revolvers are well known. The earliest handgun holders were leather holsters almost fully encasing the gun which were used to hold a gun securely. The gun would then be drawn upward until the tip of the barrel cleared the holster and then the gun could be aimed and fired. The time involved in drawing the weapon upward became disadvantageous in competitive shooting and in police work and therefore alternate types of holsters have been developed. Present handgun holders also allow for the gun to be purposefully or accidentally fired while in the holster thereby possibly causing injury.

In order to deal with the problem of possible firing while holstered and to still allow for the gun to be drawn quickly from the holster, several patents have described attempts at dealing with either the problem of possible firing while holstered or optimizing drawability. The following patents illustrate such attempts.

U.S. Pat. No. 1,113,530 to Audley discloses a holster for magazine guns, comprising a body adapted to inclose the barrel, breech and trigger guard portions of the gun, the trigger guard inclosing portion of the holster being provided with a recess in its front wall disposed longitudinally of the holster, and a locking lug in line with said recess adapted to engage the finger guard.

U.S. Pat. No. 1,917,844 to Keith discloses a holster of the shoulder type and the invention resides in the construction of the holster itself and in the means for attaching and securing the holster on the body of the wearer, so as to retain the holster substantially immovable relatively to the body and concealed from view by a jacket thus dispensing with the necessity of the wearer wearing a vest or other garment in order to conceal the securing means. This invention attempts to provide for the safety of the wearer by a pair of leaf springs which fit into the trigger guard requiring the gun be unholstered by a particular movement, however, the gun may still be fired while in the holster.

U.S. Pat. No. 2,109,734 to Preneta discloses a gun holster adapted to removably support a gun, such as a revolver. The holster comprises a rigid pressed metal frame complementarily shaped to a substantial mating contour with the gun and is supported by a flexible sheath. The frame comprises a manually operable latch releasably controlled by a lever or finger piece engageable between the trigger and trigger guard of the gun. The frame may be composed of a single sheet metal member or of several metal members secured together as desired. A manually operable latch mechanism which firmly secures the gun within frame for quick release therefrom and prevents accidental pulling of the trigger when the gun is in its secured position, however, purposeful pulling of the trigger while the gun is still holstered remains possible.

U.S. Pat. No. 3,353,728 to Freed discloses a frame of a substantially rigid material which comprises at least one ledge element extending in the horizontal direction and engages and supports the weight of a pistol carried by the frame in a barrel down position and upwardly projecting means which serve to prevent lateral movement of the pistol from the ledge portion.

U.S. Pat. No. 3,910,469 to Baldocchi discloses a U-shaped holster to conform to the portion of the body of a handgun adjacent the trigger guard so that the trigger guard and a portion of the barrel are nested in the holster. A latch is provided which extends through the trigger guard and a safety may be provided to hold the latch in the latched position.

U.S. Pat. No. 4,318,503 issued to Capano discloses an improved pistol holster with a lock-in means to prevent removal of the gun from the holster. A pin attached to a flexible strap or flap on the outer wall of the holster extends through the trigger guard of the pistol and the end of the pin is captured in holding means fastened to the inner wall of the holster. Thus, the locked-in pistol cannot be withdrawn from the holster without first pulling the strap to separate the pin from the holding means, however, the gun may still be fired while in the holster.

U.S. Pat. No. 4,870,771 issued to McClellan discloses a revolver holder comprising: a plate having a front face and a rear face; hammer engagement means upstanding from the front face of said plate for engaging the hammer; frame engagement means upstanding from the front face of said plate for engaging the frame; and keeper engagement means upstanding from the front face of said plate for engaging said keeper to hold the revolver in a fixed mounted relationship relative to said plate. The holder may also be provided with a belt buckle, but in order to remove the gun from the holder, the cylinder retention pin must be removed from the keeper engagement means, a time consuming process which renders a quick draw impossible.

U.S. Pat. No. 5,358,160 issued to Bianchi discloses an ambidextrous pistol carrying device. This device includes a mainframe member, an elongated spring member and a guard strap member connected to the mainframe member. The mainframe member includes a muzzle retainer portion, a bore-engaging protrusion on the muzzle retainer portion that extends at least partially into the bore, and left and right arm portions that extend from the muzzle portion along the sides of the pistol to positions above the trigger guard. The guard strap member includes a strap flexible material that fastens together through the trigger guard in order to inhibit premature trigger finger contact of the trigger when the pistol is drawn. Again, it is possible for the gun to go off while holstered.

The above related art summaries are merely representative of portions of the inventions disclosed in each reference. In no instance should these summaries substitute for a thorough reading of each individual reference. All of the above references are hereby incorporated by reference.

None of these references discloses a holster that would permit a gun to be withdrawn from the holster quickly and easily, while also prohibiting the gun from firing. Thus, it can be seen that there exists a need for a holster that will hold a gun securely to the person carrying it and allows for quick drawability but prevents the gun from firing while in the holster.

SUMMARY OF THE INVENTION

It is thus an object of the present invention to provide a gun holster for a pistol that allows the gun to be withdrawn from the holster quickly and easily.

It is another object of the invention to provide a gun holster that requires the gun to be drawn before it can be fired so as to prevent accidental injuries.

It is also an object of the present invention to provide a gun holster made of a unitary piece of material, which is simple and inexpensive to make and may be attached to the belt or other clothing item without any additional parts.

The foregoing and other objects are realized by the two embodiments of the present invention. In the first embodiment, the gun holster comprises a cylinder locking arm so that a revolver-type gun cannot be fired while properly holstered. In the second embodiment, an improved trigger protection arm provides the safety feature of making it far more difficult to fire the gun while it is holstered.

BRIEF DESCRIPTION OF THE DRAWINGS

These and other advantages of the present invention will become more readily apparent upon reading the following detailed description and upon reference to the drawings in which:

FIG. 1 is a top view of the first embodiment of the present invention;

FIG. 2 is a front view of the first embodiment of the present invention;

DETAILED DESCRIPTION OF THE PREFERRED EMBODIMENTS

Figure 5:
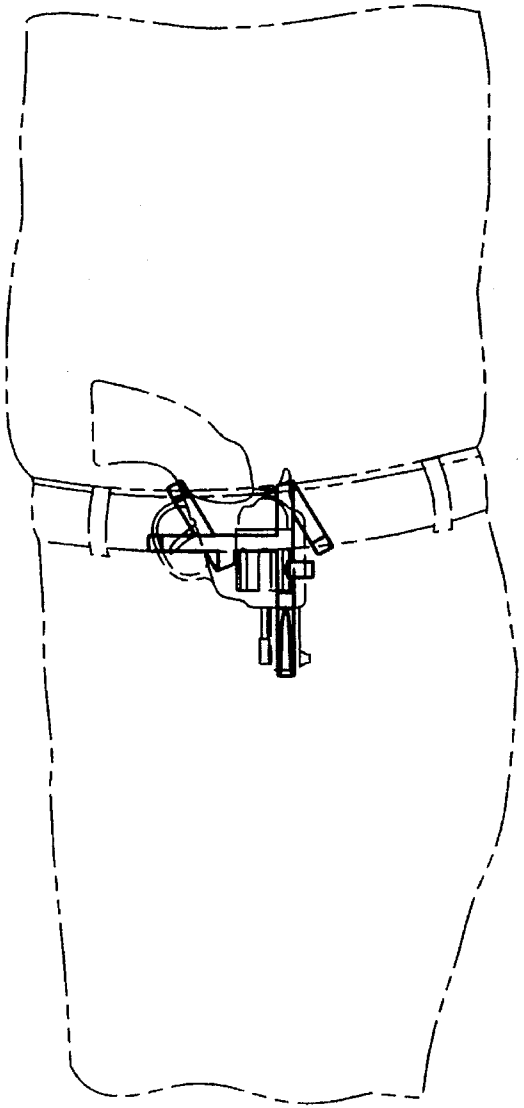
FIG. 5 is a view showing the first embodiment of the invention while in use.

Referring now to the drawings, there is illustrated a gun holster, generally designated as 10, in accordance with the preferred embodiments of the present invention, wherein like numerals refer to like elements throughout the drawings.

The first embodiment of the gun holster of the present invention is shown in FIGS. 1–5. The gun holster 10 is made of a unitary piece that may be made from metal, wood, plastic, etc. If the holster is made from metal, it may preferably be covered with leather or some other material in order to protect the gun from abrasion each time the gun is put into or taken out of the holster. The gun holster 10 comprises a main frame portion 12 having a first leg 14 and a second leg 20. The first leg 14 has a first edge 15, a second edge 16, a top edge 17, and a bottom edge 18. The second leg 20 has a first side 21, a second side 22, a top side 23, and a bottom side 24. Means 30 for mounting the holster 10 onto an object or a person are provided. As best shown in FIGS. 1 and 2, the preferable means 30 for mounting the holster are an integral part of the holster, although the mounting means may be coupled to the holster by a number of means, including being welded, snapped on, etc.

The mounting means 30 of the present invention comprises two flattened C-shaped pieces of material 31, one of which 31A extends downward from the bottom edge 18 of the first leg 14, then curves upward, rearward and backward for an adequate distance so that a belt may be held, and then recurves downward, frontward and forward, to complete the C-shape. The second flattened C-shaped piece 31B extends from the top edge 17 of the first leg 14, then curves downward, forward and rearward so that the belt may be held, and then recurves frontward, backward and upward, to complete the C-shape. The holster may then be clipped onto a belt or the belt may be fed through the interior of the C-shaped pieces. Also, the mounting means may take different configurations, such as a loop or clip, or it may be a small belt that wraps around the strap or belt of the person and the frame of the holster, or any other means known in the art.

Figure 4:
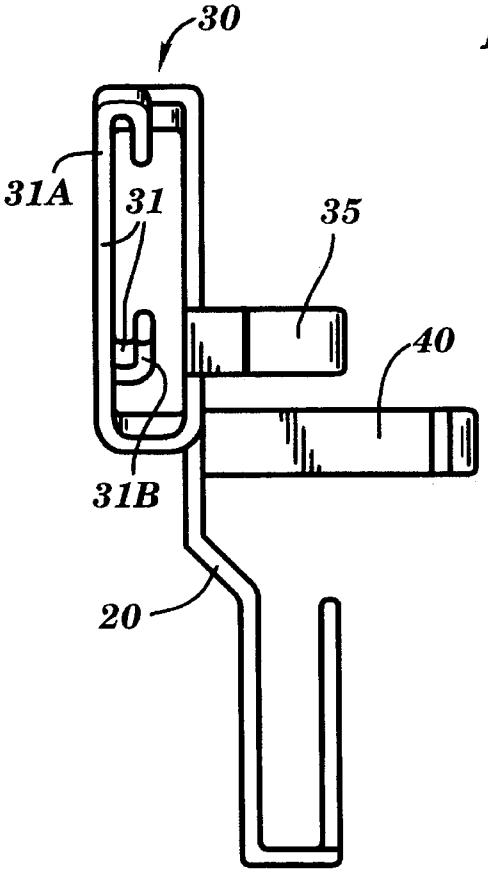
FIG. 4 is a second side view of the first embodiment of the present invention.
Figure 3:
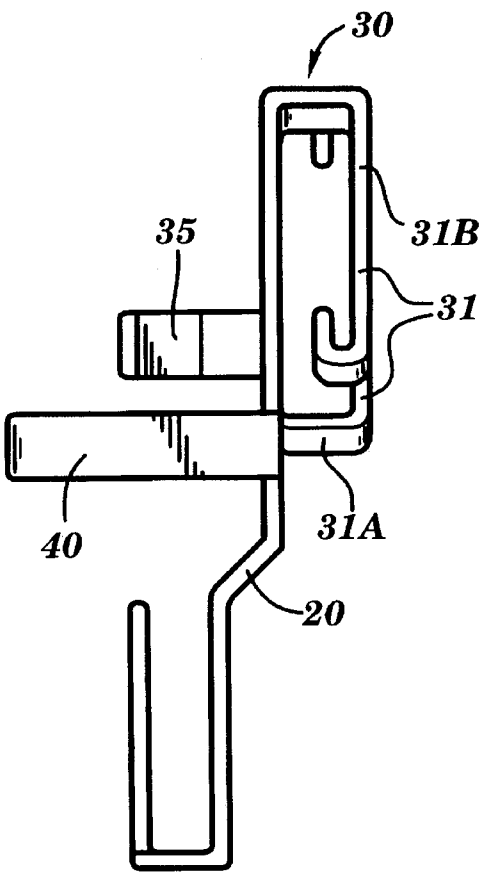
FIG. 3 is a first side view of the first embodiment of the present invention.

The gun is supported in the holster 10 by a gun supporting means 33, as shown in FIGS. 2–4. The gun supporting means 33 extends forwardly from the bottom side 24 of the second leg 20, thereby providing a ledge for the gun to rest upon. In order to prevent the movement of the gun while in the holster 10, the gun supporting means 33 preferably also extends upwardly, into the barrel of the gun. This prevents movement and also requires the gun to be drawn with an initial upwards motion, enough to clear the gun supporting means 33, thereby thwarting the drawing of the gun in a scuffle.

In order to hold the gun more securely, a lateral movement preventing means, in this embodiment a trigger guard supporting arm, 35 is provided. As shown in FIG. 2, the trigger guard supporting arm extends from the first edge 15 of the first leg 14 and wraps around the trigger guard to hold the gun in position. As shown in FIG. 1, the trigger guard supporting arm 35 is the shape of a question mark, extending forwardly from the first edge 15 of the first leg 14 to the trigger guard of the gun, then backwardly a distance, frontwardly a distance, and forwardly a distance to wrap around the trigger guard of the gun and to hamper the accidental pulling of the trigger.

The gun is locked into position and prevented from firing by a cylinder locking arm 40. The cylinder locking arm 40 is a U-shaped extension from the second side 23 of the second leg 20. The cylinder locking arm 40 is positioned along the second leg so that it will wrap around the frame of the gun and fit into a recess on the cylinder so the cylinder cannot spin and, therefore, the gun cannot be fired if properly holstered.

Figure 7:
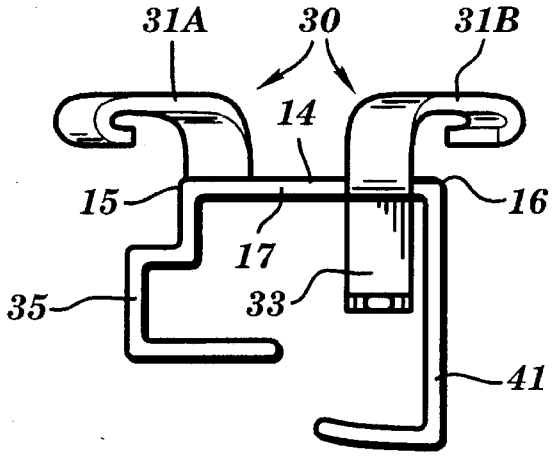
FIG. 7 is a top view of the second embodiment of the present invention.
Figure 6:
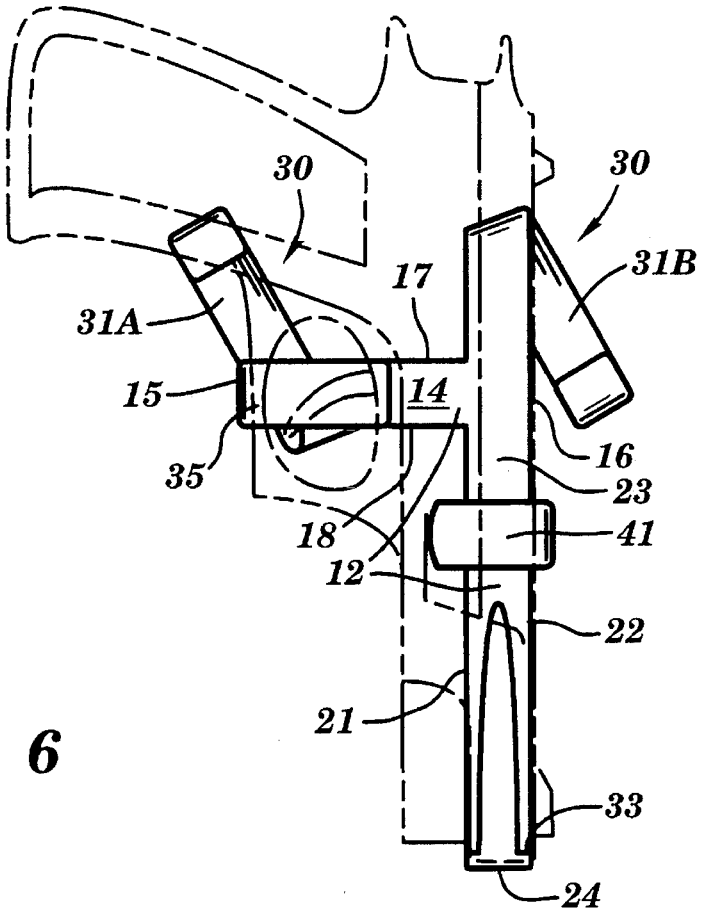
FIG. 6 is a front view of the second embodiment of the present invention.

In a second embodiment of the present invention, shown in FIGS. 6 and 7, the holster 10 is designed to hold an automatic pistol. As shown in FIG. 6, the main frame portion 12 again comprises a second leg 20 and a first leg 14. In this embodiment, however, the second leg 20 is longer relative to the first leg 14 than the previous embodiment. Means 30 for mounting the holster 10 to an object, or more specifically a person, are again provided, and preferably comprise two C-shaped pieces 31, as described above. A gun supporting means 33 and a trigger guard supporting arm 35 are also provided again, however, the trigger guard supporting arm 35 of the second embodiment is extended so that the trigger of the gun is covered on the front and rear sides. The trigger guard supporting arm 35 is substantially sized so that the trigger is relatively inaccessible and therefore the gun is more difficult to fire when holstered properly. Also in the second embodiment, the cylinder locking arm 40 of the first embodiment is replaced with a lateral movement preventing means 41, in this embodiment this comprises a frame supporting arm. The frame supporting arm 41 is again a U-shaped extension, as shown in FIG. 7, from approximately the middle of the second leg 20 of the main frame 12, as shown in FIG. 6.

The embodiments disclosed herein have been discussed for the purpose of familiarizing the reader with the novel aspects of the invention. Although preferred embodiments of the invention have been shown, many changes, modifications, and substitutions may be made by one having ordinary skill in the art without necessarily departing from the spirit and scope of the invention as described in the following claims.

What is claimed is:

1. A holster having a unitary frame for a hand gun having a cylinder, the unitary frame comprising:

a main frame portion adapted to engage with one side of the hand gun;

a means, extending from the main frame, for mounting the unitary frame;

a cylinder locking arm extending from the main frame portion, the cylinder locking arm including a means for engaging the gun when it is properly holstered so that the gun cannot be fired; and gun supporting means extending from the main frame portion, wherein the gun supporting means comprises a barrel supporting arm extending from a bottom side of the main frame portion.

2. The holster of claim 1, wherein the barrel supporting arm extends into the barrel of the gun.

3. The holster of claim 1, wherein said means for mounting the unitary frame, further comprises means for mounting the unitary frame onto a person.

4. The holster of claim 3, wherein the means for mounting the unitary frame onto a person is an integral portion of the main frame.

5. A holster for an automatic pistol having a unitary frame, the unitary frame comprising:

a main frame portion;

means, extending from, and integral with, the main frame, for mounting the gun onto an object;

a trigger guard supporting arm extending from the main frame of sufficient length and width to cover the trigger of the gun, thereby rendering it relatively difficult to fire; and a lateral movement prevention means, wherein the lateral movement prevention means comprises a frame supporting arm extending from a second side of a second leg, whereby the frame supporting arm wraps around the weapon to prevent lateral movement.

6. The holster of claim 5, wherein the means for mounting the holster onto an object comprises means for mounting the unitary frame onto a person.

7. The holster of claim 6, wherein the means for mounting the unitary frame onto a person are an integral portion of the main frame.

8. The holster of claim 5, further comprising means for supporting a gun.

9. The holster of claim 8, wherein the means for supporting a gun comprises a barrel supporting arm extending from a bottom side of a second leg.

10. The holster of claim 9, wherein the barrel supporting arm extends into the barrel of the gun.

* * * * *